US008870543B2

(12) United States Patent
Wery

(10) Patent No.: US 8,870,543 B2
(45) Date of Patent: Oct. 28, 2014

(54) LIGHTENED AXIAL COMPRESSOR ROTOR

(75) Inventor: Xavier Wery, Liègë (BE)

(73) Assignee: Techspace Aero S.A., Milmort (BE)

( * ) Notice: Subject to any disclaimer, the term of this patent is extended or adjusted under 35 U.S.C. 154(b) by 663 days.

(21) Appl. No.: 13/165,178

(22) Filed: Jun. 21, 2011

(65) Prior Publication Data

US 2011/0318185 A1 Dec. 29, 2011

(30) Foreign Application Priority Data

Jun. 23, 2010 (EP) ..... 10166959

(51) Int. Cl.
*F01D 5/30* (2006.01)
*F04D 29/32* (2006.01)

(52) U.S. Cl.
CPC ..... *F04D 29/322* (2013.01); *F04D 29/321* (2013.01); *F01D 5/3053* (2013.01); *F01D 5/3023* (2013.01)
USPC ..... 416/198 R; 416/215; 416/219 R; 416/220 R; 416/204 A; 416/239

(58) Field of Classification Search
CPC ..... F01D 5/00; F01D 5/06; F01D 5/066; F01D 5/28; F01D 5/284; F01D 5/143; F01D 5/147; F01D 5/30; F01D 5/3023; F01D 5/3053; F01D 5/3076; F04D 19/022; F04D 29/284; F04D 29/286; F04D 29/30; F04D 29/32; F04D 29/321; F04D 29/322; F04D 29/324; F04D 29/325; F04D 29/34; F04D 29/38
USPC ..... 416/198 R, 198 A, 204 R, 215, 219 R, 416/220 R, 204 A, 239
See application file for complete search history.

(56) References Cited

U.S. PATENT DOCUMENTS

| | | | | |
|---|---|---|---|---|
| 2,477,954 | A * | 8/1949 | Blanc | 415/33 |
| 2,685,405 | A | 8/1954 | Stalker | |
| 2,925,250 | A | 2/1960 | Whitehead | |
| 3,609,059 | A | 9/1971 | Wagle | |
| 5,118,257 | A * | 6/1992 | Blakeley et al. | 416/219 R |
| 2003/0143078 | A1 * | 7/2003 | Benedetto et al. | 416/219 R |

FOREIGN PATENT DOCUMENTS

| | | |
|---|---|---|
| EP | 1111246 A1 | 6/2001 |
| GB | 1163752 | 9/1969 |
| GB | 2299834 A | 10/1996 |

* cited by examiner

*Primary Examiner* — Igor Kershteyn
(74) *Attorney, Agent, or Firm* — Reinhart Boerner Van Deuren P.C.

(57) ABSTRACT

The present invention relates to a rotor stage of a compressor drum (2) for an axial turbomachine comprising a row of rotor vanes (9) each provided with a platform (12), and a wall (3) that is generally symmetrical in revolution relative to the rotation axis of the turbomachine and forming a hollow body, said wall (3) comprising a partition wall and a support zone (5) that is raised relative to the partition wall in a direction oriented towards the outside of the hollow body, said support zone (5) having a central portion (8) and side walls (7) connecting the central portion (8) to the partition wall of the drum, said platform (12) of each of said vanes (9) being assembled to said central portion (8) by means of one or more fastening elements.

22 Claims, 2 Drawing Sheets

LIGHTENED AXIAL COMPRESSOR ROTOR

FIELD OF THE INVENTION

The present invention relates, within the field of turbomachines, to a compressor rotor made of a drum and of vanes mechanically secured thereon.

BACKGROUND OF THE INVENTION

Axial compressors are well known as such and are used in turbomachines, inter alia.

These low or high-pressure compressors comprise several stages of rotary vanes, also called rotor vanes, that are separated by rectifier stages which aim to reposition the velocity vector of the fluid leaving the preceding stage before sending it towards the following stage.

The rectifier stages are essentially made of fixed vanes, also called stator vanes, connecting an outer collar to an inner collar, both concentric and defining the air flow zone or aerodynamic vein.

The stages of rotor vanes are attached to a drum. A compressor drum is generally a hollow body that is symmetrical in revolution relative to its rotation axis, which corresponds to the axis of the turbomachine. The general shape of the hollow body is oval or cone-shaped depending on the shape of the flow.

Nowadays, the drum and the rotor vanes are generally made of a titanium alloy (TA6V) and the drum comprises circumferential recesses in which the feet of the vanes are fastened by a system of bolts. One such construction is illustrated in FIG. 1 of document EP 1 111 246 B1.

Traditional architectures with recesses do however have several drawbacks that can be listed as follows:

- to prevent the opening of the recesses and thereby guarantee the resistance of the vanes and the stability of the feet within the recesses, the latter must be part of massive zones of the drums;
- the feet of the vanes that are housed in these recesses are also massive (40 to 50% of the mass of the vane); this results in a substantial centrifugal mass causing even more substantial stresses in the drum;
- the presence of recesses causes concentrations of stresses on the edge of the insertion notches. As a result, a traditional design with recesses takes on a substantial amount of material, of which only a relatively reduced portion is "useful" for the mechanical strength;
- the feet of the vanes have some positioning latitude within the recesses creating in particular rocking phenomena, which consume axial and radial clearance.

Document GB 1,163,752 presents an alternative to the fastening system with recesses in the rotor of an axial flow machine. The vane comprises a blade provided with a threaded member that engages in the rotor hub in order to allow the vane to be fastened to the hub.

AIMS OF THE INVENTION

The present invention aims to provide a solution that allows to overcome the drawbacks of the state of the art.

The present invention more particularly aims to provide a new drum architecture and an original system for fastening the vane thereto.

The present invention also aims to provide a drum deprived of its recesses and thus aims to provide a new rotor construction allowing to reduce radial and axial clearance consumption.

The present invention also aims to produce a new rotor construction allowing to optimize the choice of materials for the different elements (drum, vane) and therefore to very substantially reduce the mass.

BRIEF DESCRIPTION OF THE INVENTION

The present invention relates to a rotor stage of a compressor drum for an axial turbomachine comprising a row of rotor vanes each provided with a platform, and a wall generally symmetrical in revolution relative to the rotation axis of the turbomachine and forming a hollow body, said wall comprising a partition wall and a support zone that is raised relative to the partition wall in a direction oriented towards the outside of the hollow body, said support zone comprising a central portion and side walls connecting the central portion to the partition wall of the drum, said platform of each of said vanes being assembled to said central portion by means of one or more fastening elements.

According to particular embodiments of the invention, the rotor stage comprises at least one or a suitable combination of the following features:

- the central portion is provided, on its face outside the hollow body, with a housing intended to receive the platform of each of said rotor vanes;
- said platform covers the entire central portion;
- said platform comprises at least one fastening element and/or comprises at least one orifice allowing the passage of the fastening element;
- the central portion comprises, on its face inside the hollow body, a placement area for an additional piece, also called a sector;
- the central portion and the sector comprise at least one orifice, each allowing the passage of the fastening element;
- the central portion is connected to the side walls by rounded edges, the crest of the rounded edges delimiting an aerodynamic vein, and the side walls are connected to the partition wall of the drum by rounded sections;
- the side walls are slanted relative to a perpendicular to the rotation axis;
- the placement area is arranged on a portion that protrudes towards the inside of the support zone;
- the sector and the placement area are planar;
- the housing of the central portion is planar and cooperates with a planar surface of the platform of the vane;
- the platform has a shape that is complementary to the central portion;
- the fastening element is a bolted clip, a lockbolt or a rivet;
- the rod of each bolted clip or of each lockbolt or rivet integrally belongs to the platform of the rotor vane;
- the sector becomes sandwiched between the central portion and a nut of the bolted clip or between the central portion and a ring of the lockbolt or between the central portion and a deformed portion of the rivet;
- the rotor vanes are made of MMC (Metal Matrix Composite) aluminum, or of a titanium alloy and the drum is made of a metal material or of an organic matrix composite material.

The present invention also relates to a compressor drum for an axial turbomachine comprising at least one rotor stage as described above.

LEGEND

Figure 1:
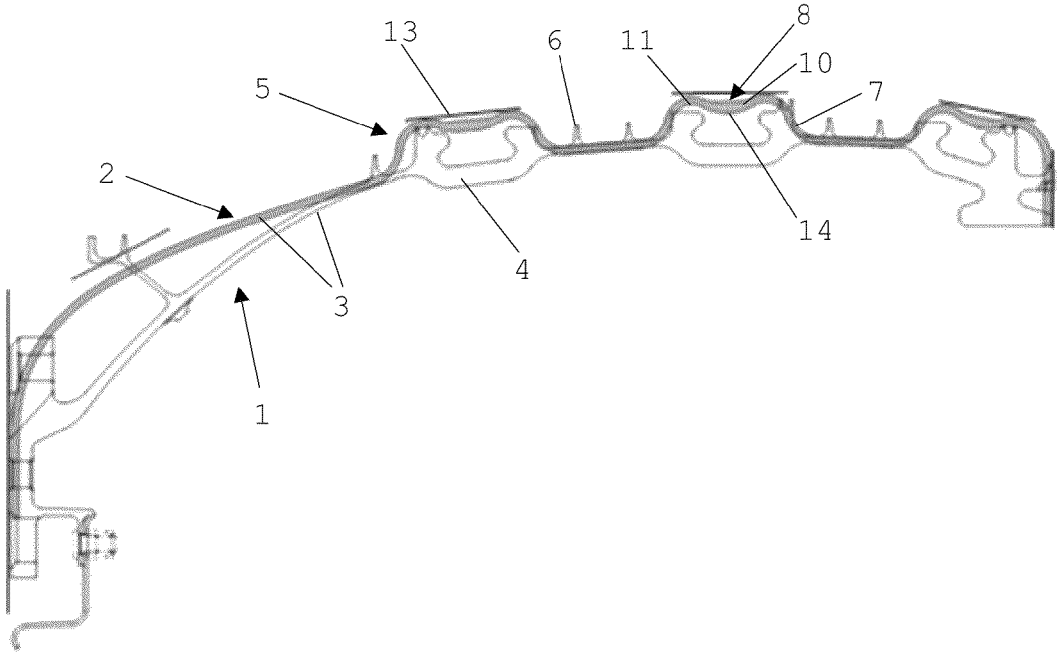
FIG. 1 shows a partial cross-section view of a traditional architecture for an axial compressor drum superimposed on a partial cross-section view of an axial compressor drum as in a first preferred embodiment of the invention (gray profile).

1. Drum as in the state of the art
2. Drum as in the invention
3. Wall of the drum
4. Recess of the prior art drum
5. Support zone
6. Sealing element
7. Side wall of the support zone
8. Central portion connecting the side walls of the support zone
9. Rotor vane
10. Hollow portion in the central portion
11. Rounded edges surrounding the hollow portion
12. Fastening platform
13. Line delimiting the aerodynamic vein
14. Protruding portion
15. Additional piece, also called sector
16. Placement area of the sector
17. Blade of the vane
18. Threaded rod
19. Nut

DETAILED DESCRIPTION OF THE INVENTION

A partial cross-section view (upper half) and an axial view, respectively, of a compressor drum as in the state of the art 1 and as in the invention 2 (in gray) are superimposed in FIG. 1. In the illustrated example, the respective drums are intended to fasten three stages of rotor vanes (not shown).

The drums 1,2 comprise a wall 3 that is generally symmetrical in rotation around a rotation axis, the wall 3 thereby forming an oval or cone-shaped hollow body. The wall 3 comprises a partition wall defining the general shape of the drum. According to the traditional architecture, the wall 3 also comprises recesses 4 intended to receive the feet of the rotor vanes. According to the present invention, the wall 3 comprises support zones 5 instead of the recesses 4. The drums 1,2 also traditionally comprise sealing elements 6 arranged between the rotor vane stages and intended to be positioned opposite the abradables of the inner collars (not shown).

The rotor architecture as in the invention and as partially shown in FIG. 3 results from the assembly of four main elements that will be described below:

- a drum wall 3 comprising support zones 5,
- rotor vanes 9 each comprising a platform 12 fastened to the support zone 5,
- fastening elements ensuring the fastening between the platforms 12 and the support zones 5,
- and pieces 15, called sectors, ensuring that the load of the stresses is taken when a force is applied on the fastening elements.

Figure 3:
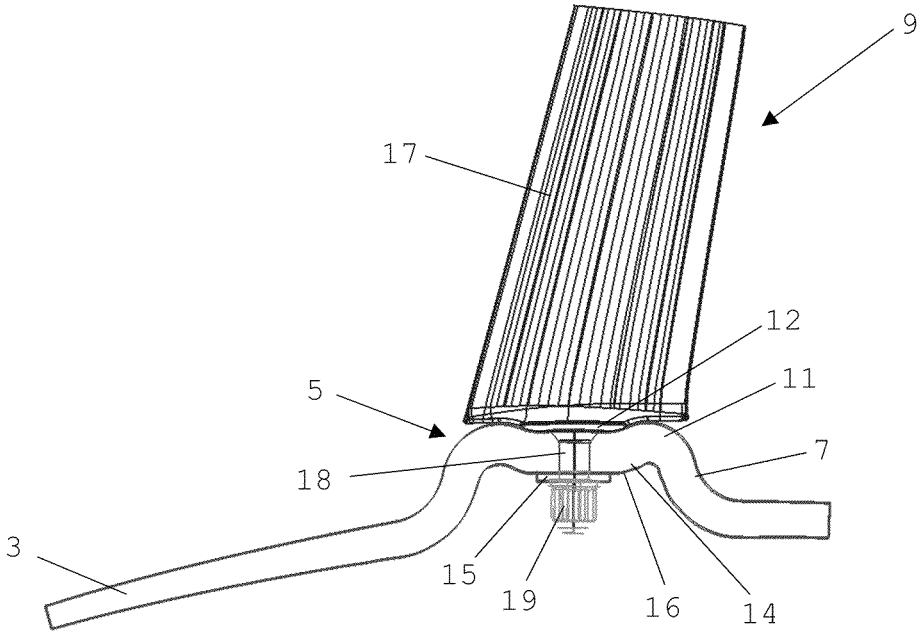
FIG. 3 shows a profile view of the fastening of the rotor vane of FIG. 2 to the drum as in the first preferred embodiment of the invention.

The support zone 5 of the wall 3 that is seen in FIGS. 1 and 3 comprises two side walls 7 and a central portion 8 joining the two side walls 7 and intended to be fastened to the rotor vane 9. The support zone 5 thereby forms an annular cavity that is open towards the inside of the hollow body and raised relative to the adjacent wall 3 forming the partition wall. According to the present invention, the side walls 7 of the support zone 5 are preferably slanted relative to a perpendicular to the rotation axis (radial direction) and connected to the partition wall by rounded sections.

According to a first preferred embodiment of the invention, the central portion 8 comprises, on its face outside the hollow body, a hollow portion 10 and rounded edges 11 connecting it to the side walls 7. The hollow portion 10 serves as a housing for the platform 12 of the rotor vane 9, as will be described below, and is preferably provided with a flat bottom. The rounded edges 11 surrounding the hollow portion 10 are located at the line 13 that delimits the aerodynamic vein (see FIG. 1). On its inner face, i.e. on its face opposite the hollow body, the central portion 8 also comprises rounded edges connecting it to the side walls 7 and a protruding portion 14 oriented towards the inside of the annular cavity formed by the support zone 5. According to this first embodiment of the invention, the protruding portion 14 can have a shape substantially corresponding to that of the hollow portion 10. Preferably, the protruding portion 14 comprises a placement area 16 for an additional piece 15, also called sector. Still preferably, the placement area 16 and the sector 15 are planar.

According to a second embodiment of the invention (not shown), the central portion 8 does not have a housing and the platform of the vane covers the entire central portion. According to this embodiment, the inner face of the central portion may comprise a protruding portion or may be provided without one. Preferably, the inner face of the central portion is provided with a placement area for the sector. Still preferably, the placement area is planar and cooperates with a sector that is also planar. According to this second embodiment of the invention, the central portion may comprise, on its outer and inner faces, rounded edges connecting it to the side walls.

According to the first and second embodiments of the invention, one or more orifices are formed through the thickness of the central portion 8 in order to allow each platform 12 to be fastened to the central portion 8. According to the first embodiment of the invention, the orifice(s) are formed through the thickness of the hollow portion 10 of the central portion 8.

The rotor vane 9 as in the invention comprises a blade 17 and a fastening platform 12 situated in a plane that is substantially perpendicular to that of the blade. According to the first embodiment of the invention, the dimensions of the platform and of the vane blade are such that the platform 12 is housed in the hollow portion 10 while the foot of the vane blade rests partially on the rounded edges 11 surrounding the housing (see FIGS. 2 and 3). Preferably, the platform 12 comprises a planar surface that cooperates with the flat bottom of the hollow portion 10. The platform may however adopt other shapes and be inserted into a housing of complementary shape. According to the second embodiment of the invention, the platform covers the entire central portion and its shape is preferably complementary to the latter.

Figure 2:
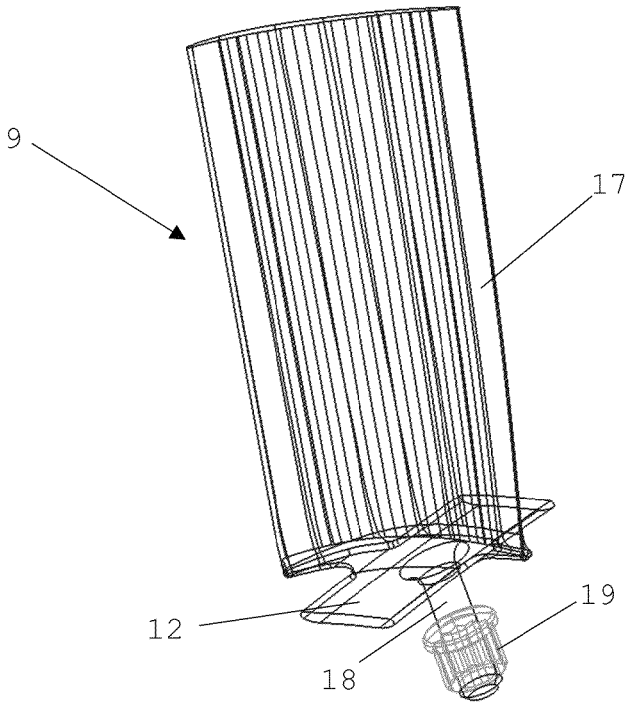
FIG. 2 shows a three-dimensional view of one preferred alternative of the rotor vane as in the invention and of the assembly nut.

In order to ensure the fastening of the platform 12 to the support zone 5, different alternatives are possible. According to one preferred alternative, the platform 12 is provided with one or more rod(s) intended to be inserted respectively in the orifice(s) formed through the thickness of the central portion 8 and allowing the support zone 5 to be fastened to the platform 12 of the vane by one or more bolted clips, one or more lockbolts, or one or more rivets. Preferably and as illustrated in FIGS. 2 and 3, the platform 12 comprises a threaded rod 18 in its center and is attached to the support zone 5 by a bolted clip. According to another alternative, the platform 12 comprises one or more orifices intended to later receive one or more fastening elements, respectively (not shown). According to still another alternative, the platform comprises one or more orifices and one or more rods (not shown).

As mentioned above, and preferably, the inner face of the central portion 8 comprises a placement area 16 for an additional piece 15, also called a sector. This piece is provided with one or more orifices intended to be placed opposite the orifice(s) formed through the thickness of the central portion. The sector allows to avoid damaging the central portion of the support zone when a force is applied on the assembly of the fastening element(s). In the example illustrated in FIG. 3, the sector 15 serves to take the load of the compression stresses when the nut 19 is screwed on the threaded rod 18. In the case of a lockbolt, the sector is placed between the rod and the ring of the lockbolt and in the case of a rivet, it is placed between the rod and the deformed portion of the rivet.

According to the present invention, the rotor vanes are, for example, made of a titanium alloy (TA6V) or of MMC (Metal Matrix Composite) aluminum. The drum as in the invention is made of an organic matrix composite material or of a metal material such as, for example, a conventional titanium alloy (TA6V).

Advantages of the Invention

The rotor as in the invention is lighter owing to its architecture, allowing to reduce the mass of the vane foot and to eliminate the recesses. This new architecture also allows to introduce new materials (composite drum, MMC aluminum vanes) that would not be compatible with a traditional design and thus allows an even more substantial mass reduction.

This drum profile allows to bring the partition wall of the drum closest to the aerodynamic vein, thereby minimizing the mass of the vane as mentioned above, the drum therefore no longer needs to bear this mass. This drum profile also allows to free up space for the feet of the stator vanes and for the inner collars.

This fastening system allows to guarantee the positioning of the vane in all operating cases, including at low rotation speeds and even stopped, unlike the traditional design where the vanes have a positioning latitude that in particular creates rocking phenomena, which consume axial and radial clearance. Eliminating the rocking of the vanes and, as a result, decreasing the axial clearance consumption allows to improve the compactness of the booster and hence the total mass of the motor.

The architecture as in the invention also allows to reduce the radial clearance consumption owing to the elimination of the periodic masses of the bolts and their balancing masses used in the traditional architecture with recesses and causing the drum to become oval. The decrease in the ovalization of the rotor allows to improve aero performance via a reduction of the radial clearance as well as to reduce their variation on a same stage.

It also allows to facilitate the assembly and clearance monitoring through the simpler to implement and more stable fastening of the vanes.

It also allows to increase the own frequencies of the system, which limits the risks of harmful vibratory phenomena (drum mode, rotor-stator interaction).

The use of composite materials for the drum of the compressor rotor allows to optimize the orientation of the fibers so as to maximize the circumferential stiffness. This results in an increase of the lifetime strength as well as in a decrease in the radial clearance consumption (less swelling of the drum than with a metal material owing to the maximization of the stiffness).

The use of composite materials for the drum also allows to minimize the rotating mass of the drum and, as a result, to reduce the amount of material needed (thickness) thereon.

The use of composite materials for the drum also allows to reduce the manufacturing costs owing to a very substantial decrease in material requirements, the mass ratio of the purchased material/piece being particularly unfavorable in the case of a titanium drum starting from a large forged piece and requiring substantial machining, unlike composite pieces.

The assembly simplicity also allows to reduce the assembly and monitoring times.

Lastly, the architecture as in the invention also provides the possibility of lightening the fan system and primarily the fan disc, owing to the decrease of the stresses on it coming from the drum, due to the lightening of the low-pressure rotor.

The invention claimed is:

1. A rotor stage of a compressor drum (2) for an axial turbomachine comprising a row of rotor vanes (9), each provided with a platform (12), and a wall (3) that is generally symmetrical in revolution relative to the rotation axis of the turbomachine and forming a hollow body, said wall (3) comprising a partition wall and a support zone (5) that is raised relative to the partition wall in a direction oriented towards the outside of the hollow body, said support zone (5) forming an annular cavity that is open towards the inside of the hollow body and said support zone (5) comprising a central portion (8) and side walls (7) connecting the central portion (8) to the partition wall of the drum, said platform (12) of each of said vanes (9) being assembled to said central portion (8) by means of one or more fastening elements.

2. The rotor stage as in claim 1, wherein the central portion (8) is provided, on its face outside the hollow body, with a housing intended to receive the platform (12) of each of said rotor vanes (9).

3. The rotor stage as in claim 1, wherein said platform (12) covers the entire central portion (8).

4. The rotor stage as in claim 1, wherein said platform (12) comprises at least one fastening element and/or comprises at least one orifice allowing the passage of the fastening element.

5. The rotor stage as in claim 1, wherein the central portion (8) comprises, on its face inside the hollow body, a placement area (16) for an additional piece (15), also called a sector.

6. The rotor stage as in claim 5, wherein the central portion (8) and the sector (15) comprise at least one orifice each allowing the passage of the fastening element.

7. The rotor stage as in claim 1, wherein the central portion (8) is connected to the side walls (7) by rounded edges (11), the crest of the rounded edges (11) delimiting an aerodynamic vein, and wherein the side walls (7) are connected to the partition wall of the drum (2) by rounded sections.

8. The rotor stage as in claim 1, wherein the side walls (7) are slanted relative to a perpendicular to the rotation axis.

9. The rotor stage as in claim 5, wherein the placement area (16) is arranged on a portion (14) that protrudes towards the inside of the support zone (5).

10. The rotor stage as in claim 5, wherein the sector (15) and the placement area (16) are planar.

11. The rotor stage as in claim 2, wherein the housing of the central portion (8) is planar and cooperates with a planar surface of the platform (12) of the vane.

12. The rotor stage as in claim 3, wherein the shape of the platform (12) is complementary to the central portion (8).

13. The rotor stage as in claim 1, wherein the fastening element is a bolted clip, a lockbolt or a rivet.

14. The rotor stage as in claim 13, wherein a rod of each bolted clip or each lockbolt or rivet integrally belongs to the platform (12) of the rotor vane.

15. The rotor stage as in claim 13, wherein the sector (15) becomes sandwiched between the central portion (8) and a nut (19) of the bolted clip or between the central portion (8) and a ring of the lockbolt or between the central portion (8) and a deformed portion of the rivet.

16. The rotor stage as in claim 1, wherein the rotor vanes (9) are made of MMC (Metal Matrix Composite) aluminum, or of a titanium alloy and wherein the drum (2) is made of a metal material or of an organic matrix composite material.

17. A compressor drum for an axial turbomachine comprising at least one rotor stage as in claim 1.

18. The rotor stage as in claim 1, wherein the central portion (8) is provided on its face outside the hollow body a hollow portion (10) that is connected to the sidewalls (7) with rounded edges (11).

19. The rotor stage as in claim 18, wherein a foot of each the vanes (9) rests partially on the rounded edges (11).

20. The rotor stage as in claim 5, wherein the placement area (16) is connected to the sidewalls (7) by rounded portions.

21. The rotor stage as in claim 1, wherein due to wall thickness along the inside a groove is formed between the central portion (8) and the side walls (7).

22. The rotor stage as in claim 1, wherein an outer periphery of the support zone tapers continuously inward along the sides walls (7) as the sidewalls (7) extend toward the central portion (8).

* * * * *